United States Patent [19]

Daussan et al.

[11] Patent Number: 5,037,672

[45] Date of Patent: Aug. 6, 1991

[54] DEVICE FOR SPRAYING A COATING ON THE INTERNAL SURFACE OF A VESSEL FOR TRANSFERRING MOLTEN METAL AND A METHOD RELATING TO SAID DEVICE

[75] Inventors: Jean-Charles Daussan, Metz; Gerard Daussan; André Daussan, both of Longeville-les-Metz, all of France

[73] Assignee: Daussan et Compagnie, Woippy, France

[21] Appl. No.: 427,101

[22] PCT Filed: Jan. 18, 1989

[86] PCT No.: PCT/FR89/00013

§ 371 Date: Sep. 19, 1989

§ 102(e) Date: Sep. 19, 1989

[87] PCT Pub. No.: WO89/06578

PCT Pub. Date: Jul. 27, 1989

[30] Foreign Application Priority Data

Jan. 20, 1988 [FR] France ..... 88 00610

[51] Int. Cl.[5] ..... B05D 1/02; B05B 13/04; B05B 13/06

[52] U.S. Cl. ..... 427/236; 118/696; 118/704; 118/317; 118/323; 239/753; 239/227; 239/264; 427/421

[58] Field of Search ..... 118/317, 323, 696, 704; 239/210, 227, 264, 751, 752, 753; 427/421, 236

[56] References Cited

U.S. PATENT DOCUMENTS

| | | | |
|---|---|---|---|
| 3,606,162 | 9/1971 | Lehmann | 118/323 |
| 4,564,410 | 1/1986 | Clitheros et al. | 118/323 |
| 4,850,382 | 7/1989 | Williams | 118/323 |
| 4,872,417 | 10/1989 | Kuwabara et al. | 239/227 |
| 4,908,234 | 3/1990 | Daussan et al. | 118/317 |
| 4,951,600 | 8/1990 | Soshi et al. | 118/323 |

FOREIGN PATENT DOCUMENTS

| | | |
|---|---|---|
| 2585273 | 1/1987 | France . |
| 2613256 | 10/1988 | France . |
| 2619323 | 2/1989 | France . |
| 57-4374 | 1/1982 | Japan . |
| 59-70461 | 4/1984 | Japan . |

OTHER PUBLICATIONS

"Robotic Gunning System for Coating a Tundish", *Iron and Steel Engineer*, vol. 64, No. 12, Dec. 1987, by S. Nonaka et al., pp. 19–23.

*Primary Examiner*—Michael Wityshyn
*Attorney, Agent, or Firm*—Young & Thompson

[57] ABSTRACT

The device for spraying a coating on the internal faces of a vessel (2) for the transfer of molten metal such as a tundish comprises a spraying lance (3) secured to a carriage (4).

The carriage (4) is capable of displacement in translational motion on a guide (6; 106) which extends in a first longitudinal or transverse direction (D; L) of the vessel (2) and which is in turn capable of translational motion on guiding means (7; 107) extending in a second direction (L; D) which is transverse with respect to direction (D; L) aforesaid. These guiding means (7; 107) are themselves mounted on a suppport (8, 12) which is capable of translational motion in the longitudinal direction (D).

11 Claims, 3 Drawing Sheets

DEVICE FOR SPRAYING A COATING ON THE INTERNAL SURFACE OF A VESSEL FOR TRANSFERRING MOLTEN METAL AND A METHOD RELATING TO SAID DEVICE

The present invention relates to a device for spraying a refractory and/or heat-insulating and/or water-repellent coating on the internal faces of a vessel such as a tundish for transferring molten metal, said coating being either permanent or else a wearing coating according to requirements.

The invention is also directed to a method for the practical application of the device in accordance with the invention.

A coating of this type is described, for example, in French patent No. 2,585,273 granted to the present Applicant.

In French patent Applications No. 87 04694 of Apr. 3rd, 1987 and No. 87 11466 of Aug. 12th, 1987, the present Applicant describes in addition a machine for preparing and spraying a similar coating.

A method of coating which is already known consists in pouring the coating composition into the space located between a former and the internal surface of the vessel to be coated.

The use of a former of this type is unpractical and does not make it possible to modify the thickness of the coating at will.

At the present time, in order to spray a coating of this type into a transfer vessel, use is made of a robot having articulated arms, the movements of which are remote-controlled.

A robot of this type is of heavy and complex construction, with the result that it is very costly.

There has also been proposed a spraying device comprising a beam fixed above a small transfer vessel along the longitudinal axis of this latter, a carriage for supporting the lance used for spraying the coating being capable of displacement in translational motion on said beam. This device is economical but is suitable only for metallurgical vessels of small size. Moreover, the device does not make it possible to spray the coating at a constant distance between the head of the spraying lance and the internal faces of the vessel, with the result that the coating has irregular compactness, which is unacceptable.

This device is unsuitable, especially in the case of transfer vessels which have non-parallelepipedal geometrical shapes and the side walls of which are not vertical but inclined.

The object of the present invention is to overcome the disadvantages of known designs by producing a spraying device of simple and inexpensive construction which makes it possible to obtain a coating of uniform compactness irrespective of the dimensions and shape of the transfer vessels.

The device contemplated by the invention for spraying a coating onto the internal faces of a vessel for the transfer of molten metal comprises a spraying lance secured vertically to a carriage which is displaceable in a horizontal plane located above the transfer vessel.

In accordance with the invention, this device is characterized in that the carriage is capable of displacement in translational motion on a guide which extends in a first longitudinal or transverse direction of the transfer vessel, that said guide is in turn capable of displacement in translational motion on guiding means extending in a second direction which is transverse with respect to the direction aforesaid, that said guiding means are themselves mounted on a support which is capable of displacement in translational motion in the longitudinal direction of the vessel, and that means are provided for controlling the various movements of the spraying lance in such a manner as to maintain the spraying head of said lance at a substantially constant distance from the lateral faces or from the bottom face of the transfer vessel.

In view of the fact that the spraying device as a whole can be displaced in the longitudinal direction of the transfer vessel, said device can be of smaller overall length than the vessel and is thus suitable for vessels having both small and large dimensions.

In view of the fact that the carriage is capable of moving in a direction transverse to the length of the vessel, it is possible to adjust the distance between the head of the spraying lance and the side wall of the vessel, even when this side wall is not vertical but inclined or else not parallel to the longitudinal direction of the transfer vessel.

In an advantageous embodiment of the invention, the spraying lance is capable of displacement in rotation and in translational motion on a vertical axis.

These displacements of the spraying lance in combination with the other movements of the device in accordance with the invention make it easier to maintain a constant distance between the head of the lance and the internal surface of the transfer vessel irrespective of the shape of this latter.

In a preferred embodiment of the invention, the support of the device is capable of displacement in translational motion on guiding means which extend parallel to the longitudinal direction of a plurality of transfer vessels disposed in a row.

The same device of simple, compact and inexpensive construction is thus capable of coating in series a plurality of tundishes placed in a row.

Once the coatings have been completed, it is only necessary to withdraw the device to a parking area located beyond the last transfer vessel.

According to a further aspect of the invention, the method for the practical application of the spraying device in accordance with the invention involves the following steps :

a) the support of the device is displaced so as to place it in position above the vessel, b) the bottom face of the vessel is coated by spraying parallel coating strips while displacing the carriage in the longitudinal direction of the vessel and in the direction perpendicular to this latter in order to pass from one strip to another while at the same time maintaining the head of the spraying lance at a constant distance from the bottom face, c) at least one longitudinal lateral face and at least one transverse lateral face of the vessel are coated by spraying parallel coating strips while displacing the carriage in the longitudinal or transverse direction of the vessel and displacing the lance head in pivotal motion about its axis through an angle of 90° at the end of a longitudinal strip in order to spray a strip on the transverse face or conversely and, in order to pass from one strip to another, the lance head is displaced vertically and the carriage is displaced transversely or longitudinally in order to maintain a substantially constant distance between the lance head and the lateral face of the vessel, d) steps b) and c) may be reversed.

Further particular features and advantages of the invention will become apparent from the description given hereinafter. In the accompanying drawings which are given by way of non-limitative example :

Figure 1:
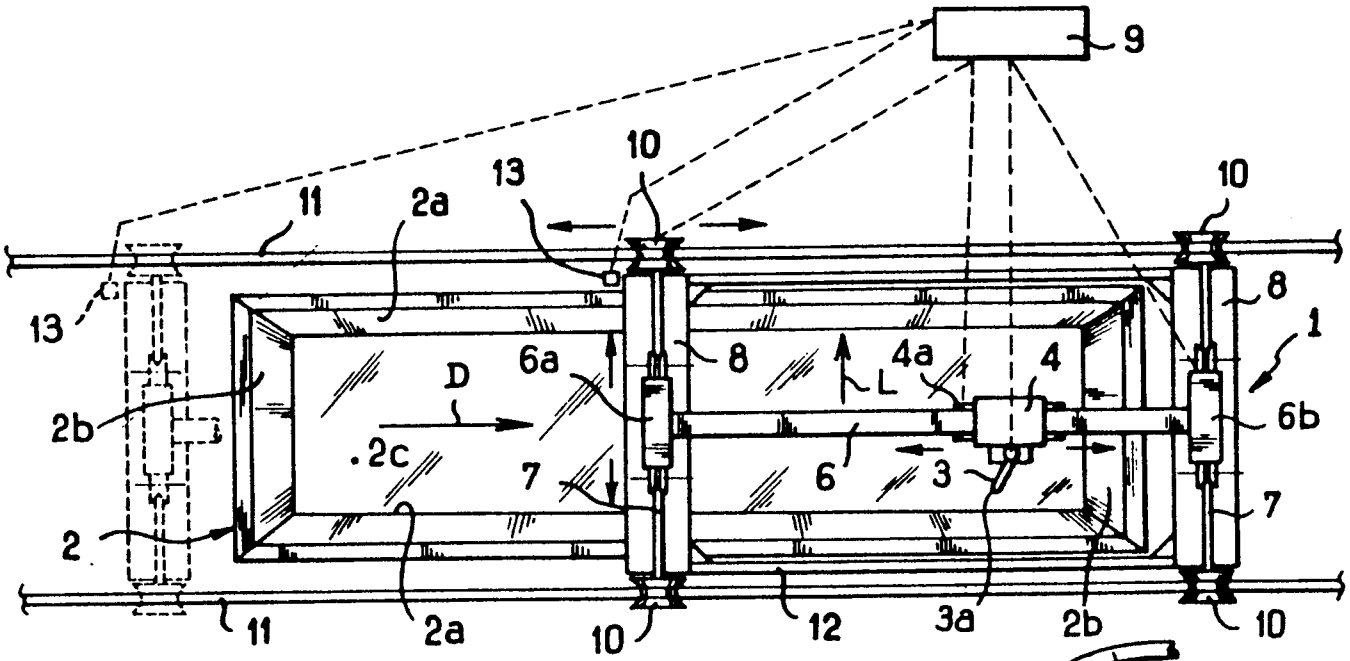
FIG. 1 is a schematic plan view of the device in a first embodiment of the invention, in position on a transfer vessel.
Figure 2:
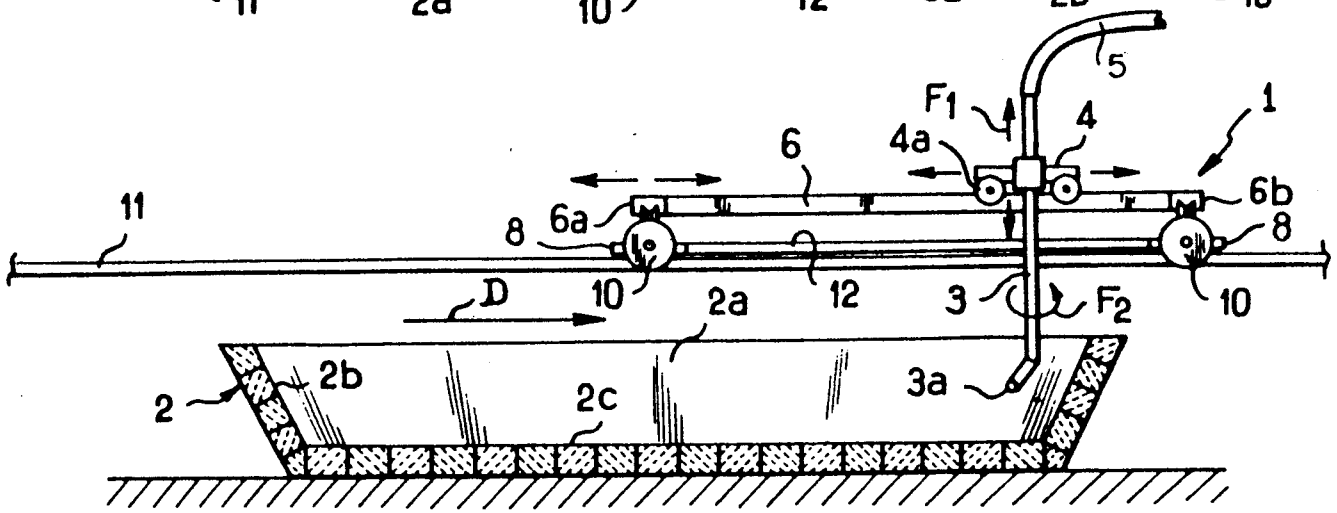
FIG. 2 is a view in elevation of the device of FIG. 1, in position above the transfer vessel which is shown in longitudinal cross-section.

In the embodiment of FIGS. 1 and 2, there is shown a device 1 for spraying a refractory and/or heat-insulating and/or water-repellent coating on the internal faces of a tundish 2. This coating can be permanent or else can be a wearing coating.

This spraying device comprises a spraying lance 3 secured vertically to a carriage 4 which is capable of displacement in a horizontal plane located above the tundish 2. The lance 3 is connected to a flexible pipe 5 which is in turn connected to a machine for preparation and pressurization of a coating composition in the form of a slurry as described, for example, in French patent Applications No. 87 04694 of Apr. 3rd, 1987 and No. 87 11466 of Aug. 12th, 1987 in the name of the present Applicant.

In accordance with the invention, the carriage 4 is mounted so as to be capable of displacement in translational motion on a guide 6 which extends in the longitudinal direction D of the tundish 2. Said guide 6 is in turn capable of translational displacement on guiding means 7 which extend transversely to the aforesaid longitudinal direction D.

Said guiding means 7 are themselves mounted on a support 8 which is capable of displacement in translational motion in the longitudinal direction D of the tundish 2.

Means 9 such as a microcomputer associated with motors are provided for controlling the various movements of the spraying lance 3 carried by the carriage 4 so as to ensure that the head 3*a* of said lance is maintained at a substantially constant distance from the lateral faces 2*a* and 2*b* and from the bottom face 2*c* of the transfer vessel.

In the embodiment shown, the spraying lance 3 is also capable of moving in translation and in rotation along a vertical axis (see arrows F1 and F2 of FIG. 2).

The guide 6 which extends in the longitudinal direction D is a beam on which the carriage 4 is movably mounted by means of runner-wheels 4*a*.

The opposite ends of the beam 6 have two carriages 6*a*, 6*b* equipped with runner-wheels and movably mounted on two cross-members 8 which extend at right angles to the longitudinal direction D of the tundish 2.

The opposite ends of the cross-members 8 are provided with runner-wheels 10 mounted on two guide rails 11 which extend respectively on each side of the longitudinal lateral faces 2*a* of the tundish 2.

The two cross-members 8 are connected to each other by means of longitudinal members 12 which are secured to the ends of said cross-members 8 so as to form a rigid frame.

In the embodiment shown, the length of said frame is substantially equal to one-half the length of the tundish 2 whilst its width is slightly greater than the width of said tundish.

Thus, by displacing the carriage 4 on the beam 6 and by displacing the carriages 6*a*, 6*b* of the beam on the transverse guides 7, the interior of the tundish can be coated over one-half of its length and over its entire width.

Figure 3:
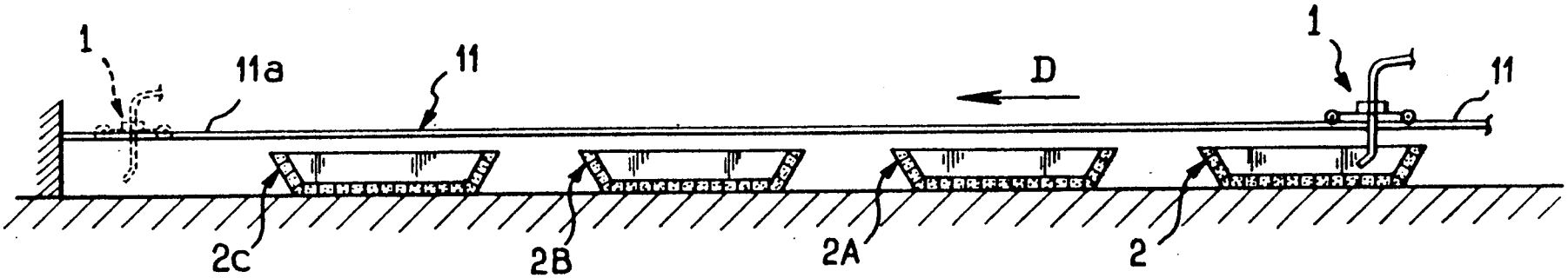
FIG. 3 is a view in elevation of the device of FIG. 1 which is capable of displacement above a plurality of transfer vessels arranged in a row and shown in longitudinal cross-section.
Figure 4:
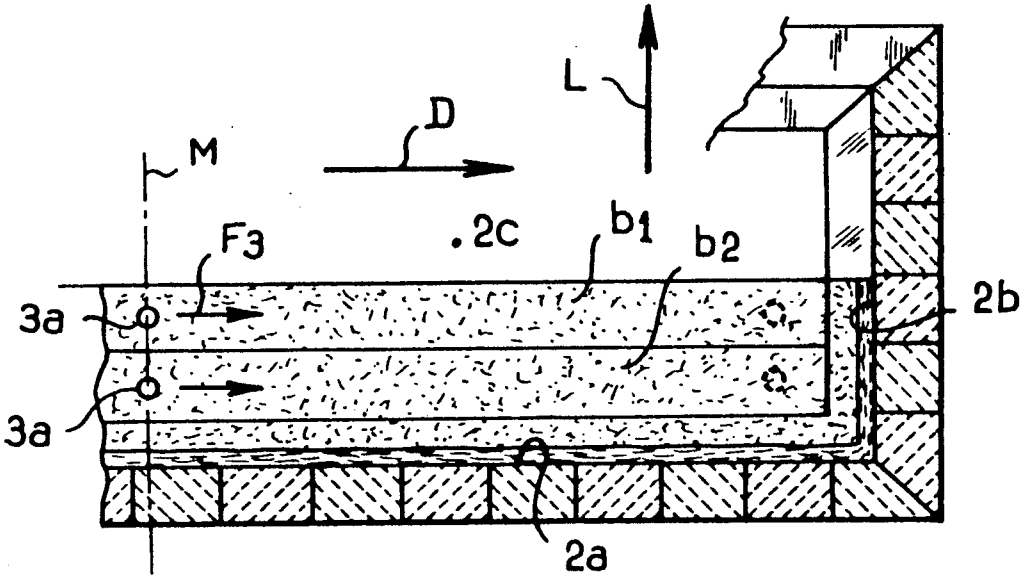
FIG. 4 is a fragmentary plan view of a transfer vessel showing the coating deposited by spraying on the bottom face of said vessel.

In the embodiment of FIG. 3, the device 1 is mounted on rails 11 which extend parallel to the longitudinal direction D of several tundishes 2, 2A, 2B, 2C placed in a row.

Said guide rails 11 extend beyond the end of the tundish 2C located at the end of a row so as to constitute a parking area 11*a* of the device 1 at a location which is free from the top opening of each tundish.

The displacements of the device 1 as a whole on the rails 11, of the carriages 6*a*, 6*b* of the beam 6, of the carriage 4 on the beam 6, the translational motion and rotational motion of the lance 3 carried by the carriage 4,are controlled automatically by means of the microcomputer 9 in accordance with a predetermined operating cycle which ensures that the head 3*a* of the lance 3 remains at a constant distance from the internal surface of the tundishes 2, 2A, 2B, 2C.

The ends of travel of the device on the rails 11 can be determined by electric contactors 13 (see FIG. 1) which stop the operation of the driving motor of the device when this latter reaches a position in which it is capable of coating one-half of the internal surface of a tundish.

Thus in the case of each tundish, the device 1 will occupy two successive positions, namely the position shown in full lines in FIGS. 1 and 2 and the position shown in dashed lines in FIG. 1.

Figure 6:
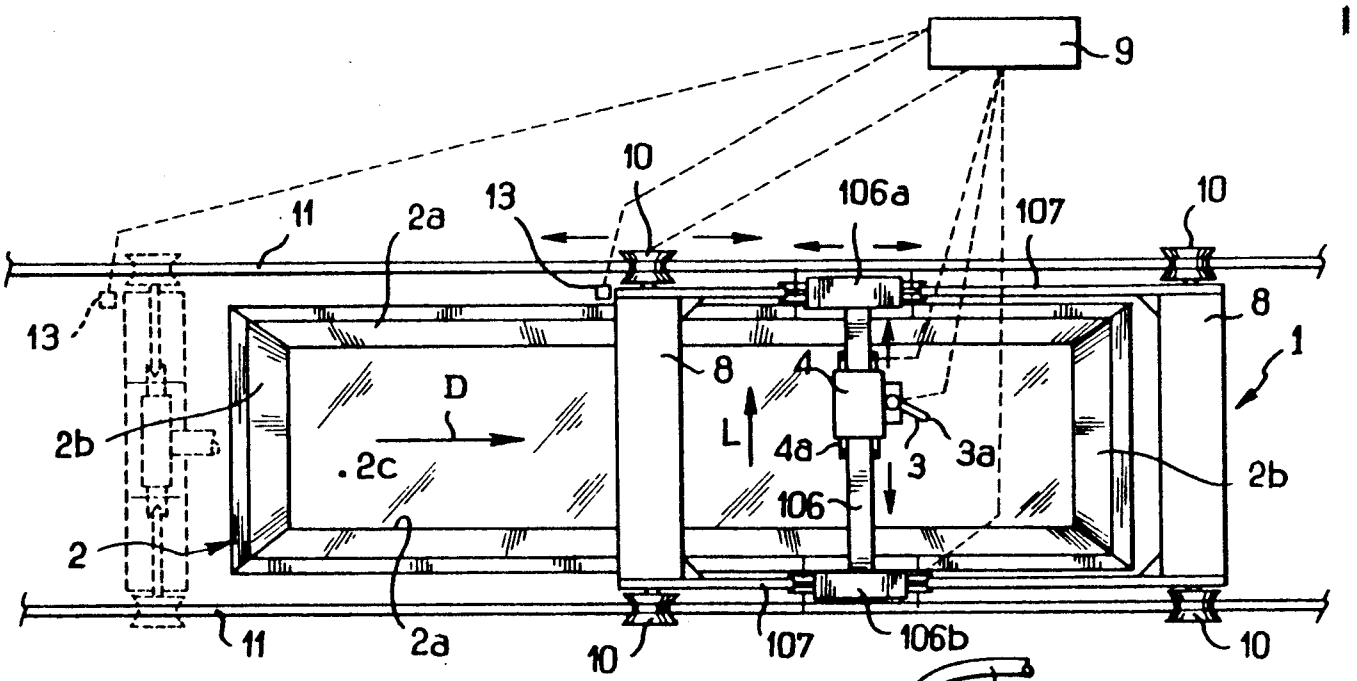
FIG. 6 is a view which is similar to FIG. 1 and shows a device in accordance with a second embodiment of the invention.
Figure 7:
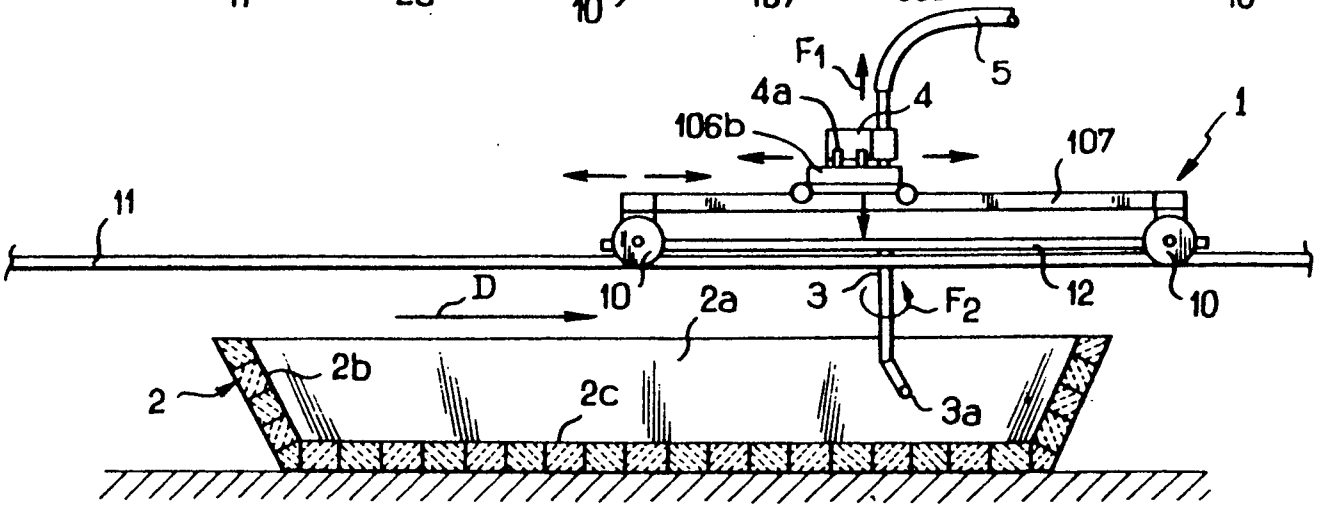
FIG. 7 is a view which is similar to FIG. 2 and shows the device of FIG. 6.

In the embodiment of FIGS. 6 and 7, the carriage 4 is mounted so as to be capable of translational displacement on a guide 106 which extends in the transverse direction L of the tundish 2. Said guide 106 is in turn capable of translational displacement on guiding means 107 which extend in the aforesaid longitudinal direction D.

The guiding means 107 are themselves mounted on the longitudinal members 12 which constitute with the cross-members 8, as in the first embodiment described in the foregoing with reference to FIGS. 1 and 2, a support which is capable of translational motion in the longitudinal direction D of the tundish 2.

The other distinctive features of this second embodiment are identical with those of the first embodiment.

There will now be described by way of nonlimitative limitative example the practical operation of the spraying device in accordance with the first embodiment of the invention, reference being made to FIGS. 1 to 5.

In a first stage, the device 1 is displaced on the rails 11 in order to place it in position above the tundish 2 as indicated in FIG. 1. In this position, the head 3*a* of the lance 3 is capable of sweeping the entire surface of the tundish over one-half of its length.

The operation is begun by coating the bottom face 2c of the tundish by displacing the carriage 4 in a direction $F_3$ (see FIG. 4) parallel to the direction D so as to deposit by spraying a coating strip $b_1$ which extends between the center M of the tundish and the transverse lateral face 2b.

Another coating strip $b_2$ is then deposited by spraying in juxtaposed relation to the first strip after having displaced the carriages 6a and 6b at right angles to the longitudinal direction D. The operation is carried out in this manner until the entire half-width of the bottom face 2c of the tundish has been covered. During this spraying operation, the head 3a of the lance remains at a constant distance from the bottom face 2c.

Figure 5:
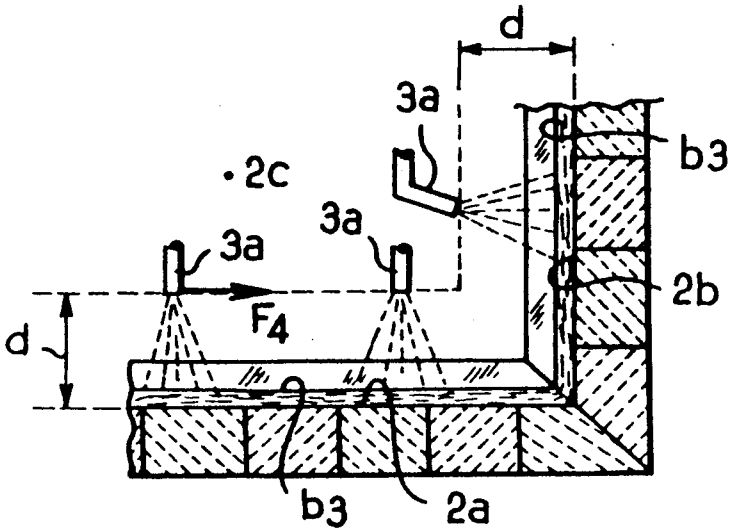
FIG. 5 is a fragmentary plan view of the transfer vessel showing the spray deposition of the coating on the lateral faces of said vessel.

A longitudinal lateral face 2a and a transverse lateral face 2b are then coated by spraying successive parallel and juxtaposed strips such as the strip $b_3$ (as shown in FIG. 5). To this end, the head 3a of the lance is brought to the desired distance d from the wall 2a and the carriage 4 is displaced in the direction $F_4$ which is parallel to the length D. When the head 3a is located at a distance d from the transverse face 2b, the head 3a is rotated through an angle of 90° and the carriages 6a, 6b are displaced in a direction perpendicular to D.

The following strip is sprayed in the same manner. In view of the fact that the lateral walls 2a and 2b are inclined, the distance d between the head 3a and the internal surface of the tundish is maintained by means of the carriages 6a, 6b (in the case of the wall 2a) and by means of the carriage 4 (in the case of the wall 2b).

The same procedure is adopted for the other half-width and the other half-length of the tundish.

The operation of the spraying device in accordance with the second embodiment of the invention is wholly comparable with the procedure described in the foregoing. Thus the carriage 4 moves along the beam 106 along the transverse direction L with respect to the tundish 2 whilst the beam 106 in turn moves along the longitudinal guides 107.

As can be understood, it is also possible to reverse the steps described in the foregoing and to perform the coating operation first on the transverse and longitudinal lateral faces (in any order and direction) and then on the bottom face of the tundish.

The principal advantages of the spraying device which has just been described are as follows :

The device is of simple, lightweight and compact construction and does not interfere with the access to the different tundishes.

Its different elements are displaced in simple movements of translation and rotation which can readily be programmed.

These various movements serve to maintain the head 3a of the lance at a constant distance from the internal surface of the tundish at any point of this latter, thus making it possible to obtain a coating which has a uniform degree of compactness.

Moreover, in spite of its small dimensions, the device is capable of coating the interior of several tundishes in a row.

It should be clearly understood that the invention is not limited to the examples of construction which have just been described and that any number of modifications can be made in these latter without thereby departing from the scope of the invention.

Thus the structure of the device can be modified on condition that the different fundamental movements of the carriage 4 are retained.

Similarly, the microcomputer 9 can be replaced by remote controls actuated manually by an operator or installed in parallel with such controls. The length of the longitudinal members 12 can be different from the length indicated above and steps can be taken to ensure that the lance 3 is capable of rotating about its own axis through a number of successive quarter-revolutions.

Furthermore, detection means can be associated with the programmed microcomputer or with the manually actuated remote controls for controlling the movements of the carriage 4 and of the lance 3. Said detection means make it possible to maintain a constant distance between the surface to be coated and the head 3a of the spraying lance and may consist, for example :

of sensitive telescopic rods for detecting a constant distance and producing action on switches which are capable of controlling the different motors for ensuring the powered mobility of the device, ultrasonic probes, infrared-radiation probes.

On the other hand, the practical application of the device and of the coating can be different from those described. Thus, if the width of the tundish 2 and the conditions of spray deposition of said coating are appropriate, it can be possible, in particular with the device in accordance with the first embodiment, the device being placed at one end of the tundish, to coat the transverse face 2b and the beginning of the two longitudinal faces 2a without displacing either the carriage 4 or the beam 6, simply by pivoting the spraying lance 3 and if necessary by adjusting its level in height, and to terminate the coating by displacing the carriage 4 lengthwise along the beam 6 and by displacing this latter along the rails 11.

We claim:

1. Device for spraying a coating onto internal faces of a transfer vessel (2) for transfer of molten metal, comprising a spraying lance (3) secured vertically to a carriage (4) displaceable in a horizontal plane located above a said transfer vessel, characterized in that the carriage (4) is capable of displacement in translational motion on a guide (6; 106) extending in a first longitudinal or transverse direction (D; L) of a said transfer vessel (2), that said guide (6; 106) is in turn capable of displacement in translational motion on guiding means (7; 107) extending in a second direction (L; D) aforesaid, that said guiding means (7; 107) are themselves mounted on a support (8, 12) capable of displacement in translational motion in the longitudinal direction (D) of the vessel and that means (9) are provided for controlling the various movements of the spraying lance (3) in such a manner as to maintain a spraying head (3a) of said lance at a substantially constant distance from lateral faces (2a, 2b) or from a bottom face (2c) of a said transfer vessel.

2. Device in accordance with claim 1, characterized in that the spraying lance (3) is capable of displacement in rotation about and in translational motion along a vertical axis.

3. Device in accordance with claim 1, characterized in that the guide (6) extends in the longitudinal direction (D) of a said transfer vessel and is a beam whose length is less than that of the vessel (2).

4. Device in accordance with claim 3, characterized in that the opposite ends (6a, 6b) of the beam (6) are movably mounted on two cross-members (8) extending at right angles to the longitudinal direction (D) of a said transfer vessel.

5. Device in accordance with claim 4, characterized in that the opposite ends of the cross-members (8) are movably mounted on guide rails (11) extending respectively on each side of and parallel to two longitudinal lateral walls (2*a*) of a said transfer vessel.

6. Device in accordance with claim 1, characterized in that the support (8, 12) of the device (1) is capable of displacement in translational motion on further guiding means (11) which extend parallel to the longitudinal direction (D) of a plurality of said transfer vessels (2, 2A, 2B, 2C) placed in a row.

7. Device in accordance with claim 6, characterized in that said further guiding means (11) of the support (8, 12) extend beyond the end of a said transfer vessel located at the end of a row of said transfer vessels so as to constitute a parking area (11*a*) of the device.

8. Device in accordance with claim 1, characterized in that the means (9) for controlling the various movements comprise motors which are associated with a microcomputer programmed for controlling said motors in accordance with a predetermined operating cycle, or which are manually remote-controlled by an operator.

9. Method for the spraying of a coating onto internal faces of a transfer vessel (2) for the transfer of molten metal from a spraying device comprising a spraying lance (3) having a spray head (3*a*), said lance (3) being carried by a carriage (4) on a support (8, 12), characterized by the following steps:

a) the support (8, 12) of the device is moved so as to place the support in position above a said vessel (2), b) a bottom face (2*c*) of a said vessel (2) is coated by spraying parallel coating strips (b1, b2) while displacing the carriage (4) in the longitudinal direction (D) of the vessel and in a horizontal direction perpendicular to said longitudinal direction in order to pass from one strip to another while at the same time maintaining said head (3*a*) of the spraying lance (3) at a constant distance from said bottom face (2*c*), c) at least one longitudinal lateral face (2*a*) and at least one transverse lateral face (2*b*) of a said vessel (2) are coated by spraying parallel coating strips (b3) while displacing the carriage (4) in the longitudinal direction (D) or transverse direction (L) of the vessel (2) and displacing said head (3*a*) in pivotal motion about a vertical axis through an angle of 90° at the end of a longitudinal strip in order to spray a strip on a transverse lateral face (2*b*) and, in order to pass from one strip to another, said head (3*a*) is displaced vertically and the carriage (4) is displaced transversely or longitudinally in order to maintain a substantially constant distance (d) between said head (3*a*) of the lance (3) and a lateral face (2*a*, 2*b*) of the vessel, d) steps b) and c) can be reversed.

10. Method in accordance with claim 9, characterized in that the vessel (2) is first coated over a half-width of a half-length of this latter, whereupon the remainder of the half-length is coated by displacement of the carriage (4) in the transverse direction whilst the support (8, 12) remains stationary and the remaining half-length of the vessel is coated after displacement of the support in the longitudinal direction (D).

11. A method for spraying a coating onto internal faces of a transfer vessel (2) for the transfer of molten metal, wherein a spraying lance (3) is secured vertically to a carriage (4) and said carriage is displaced in a horizontal plane located above a said transfer vessel, characterized in that the carriage (4) is displaced in translational motion on a guide (6; 106) extending in a first longitudinal or transverse direction (D; L) of a said transfer vessel (2), that said guide (6; 106) is displaced in translation motion on guiding means (7; 107) extending in a second horizontal direction (L; D) transverse with respect to the first-mentioned direction (D; L), that said guiding means (7; 107) are themselves mounted on a support (8, 12) which is displaceable in translational motion in the longitudinal direction (D) of a said vessel and that the various movements of the spraying lance (3) are controlled in such a manner as to maintain the spraying head (3*a*) of said lance at a substantially constant distance from lateral faces (2*a*, 2*b*) or from a bottom face (2*c*) of the transfer vessel.

* * * * *